United States Patent [19]

Erard

[11] 4,382,690

[45] May 10, 1983

[54] ULTRA-FLAT ELECTRONIC WATCH

[75] Inventor: Raoul H. Erard, La Chaux-de-Fonds, Switzerland

[73] Assignee: Ebauches, S.A., Switzerland

[21] Appl. No.: 73,553

[22] Filed: Sep. 6, 1979

[51] Int. Cl.[3] ..... G04B 19/20

[52] U.S. Cl. ..... 368/77; 368/233

[58] Field of Search ..... 58/5, 23 R, 23 AC, 23 D, 58/59, 125 B, 126 A; 368/37, 38, 77, 76, 88, 220, 221, 233, 234

[56] References Cited

U.S. PATENT DOCUMENTS

| | | | |
|---|---|---|---|
| 2,248,195 | 7/1941 | Prins | 58/125 B |
| 2,582,797 | 1/1952 | Rosfelder | 368/234 |
| 2,852,908 | 9/1958 | Stern et al. | 368/234 |
| 3,587,223 | 6/1971 | Zatsky | 368/76 |
| 4,087,957 | 5/1978 | Miyasaka et al. | 58/23 BA |

FOREIGN PATENT DOCUMENTS

| | | | |
|---|---|---|---|
| 2204907 | 8/1973 | Fed. Rep. of Germany | 368/88 |
| 2312053 | 1/1977 | France | 58/104 |
| 48-67767 | 8/1973 | Japan | 368/77 |

*Primary Examiner*—Vit W. Miska

*Attorney, Agent, or Firm*—Allegretti, Newitt, Witcoff & McAndrews, Ltd.

[57] ABSTRACT

The watch of the invention contains a power cell 46, a quartz crystal 44, a step-by-step motor 42, a gear train 32 and a device for the analog display of the time constituted by two coaxial discs provided with index marks 24, 26 and each having external teeth so that they can be driven by the gear train. These components are all located inside a casing 10, 12 with a transparent window 14 and whose back acts as a bottom plate. All "thick" elements of the watch (cell 46, crystal 44, motor 42, gear train 32) are outside the periphery of the discs without overlapping, when viewed in a direction perpendicular to the front plate of the watch, and are partially recessed into the underside of the rim 12 of the casing. The integrated circuit 50 may be hidden by the discs or also outside their periphery.

10 Claims, 5 Drawing Figures

ULTRA-FLAT ELECTRONIC WATCH

BACKGROUND OF THE INVENTION

The present invention relates to an electronic watch having analog display means and, more specifically, to an ultra-flat analog electronic watch in which relatively thick elements are arranged without overlapping, outside the field of the display device which is recessed in the centre of these elements.

A watch of the type just described is commercially available at present and is described in our Swiss Patent Application No. 9854/78 filed on Sept. 21, 1978. In one illustrative embodiment of the invention, an ultra-flat 1.98 mm thick watch, known by the names "ESA 999" and "DELIRIUM", the central portion contains only the hands, the dial, and the gear train whose moving parts actually pivot in the back of the casing, which acts as the watch plate.

Mechanical watches have been known for a long time, in which the hour and the minute are displayed by means of simulated hands formed by index marks deposited either on two parallel discs, as described, for example, in French Pat. No. 1,085,177, or on an outer rim and an inner disc arranged in the same plane, as described, for example, in Swiss Pat. No. 514,874. In both cases, the barrel is arranged beneath the display and actuates the hour indicator either directly (French patent) or by means of an hour wheel fixed on the spindle of the indicator (Swiss patent).

These mechanical watches with discs inevitably are quite thick. In addition, a construction involving disc display means has not been available in electronic watches up until now.

The object of the present invention is to provide an ultra-flat electronic watch with a disc display means.

BRIEF SUMMARY OF THE INVENTION

According to the present invention, there is provided an electronic watch containing a power cell, a quartz crystal resonator, an integrated circuit, a motor, a gear train which is driven by the motor and a time display device visible beneath a glass and comprising two coaxial discs which are provided with index marks and have external teeth whereby they are driven by the gear train, all located inside a casing which includes the glass and whose back acts as the watch plate. The power cell, the quartz crystal resonator, the motor and the gear train are arranged, without substantially overlapping, outside the periphery of the discs.

The present invention comprises considerably more than the mere use of disc display means in an ultra-flat watch, since it represents both a modification of the teaching of "ESA 999" by eliminating the gear train from the center of the watch and a modification of the teaching of twin disc display watches by driving the discs at their circumference. This novel arrangement results in a disc-type watch which can be extremely flat, as none of its relatively thick components, constituted by the display device, the gear train, the quartz resonator, the motor and the power cell substantially overlap when viewed in a direction perpendicular to the front plate of the watch.

Other features of the present invention will be disclosed in the following description, which is disclosed by way of example with reference to the accompanying drawings and which portrays two advantageous embodiments of a watch according to the invention.

DETAILED DESCRIPTION OF THE PREFERRED EMBODIMENT

Figure 1:
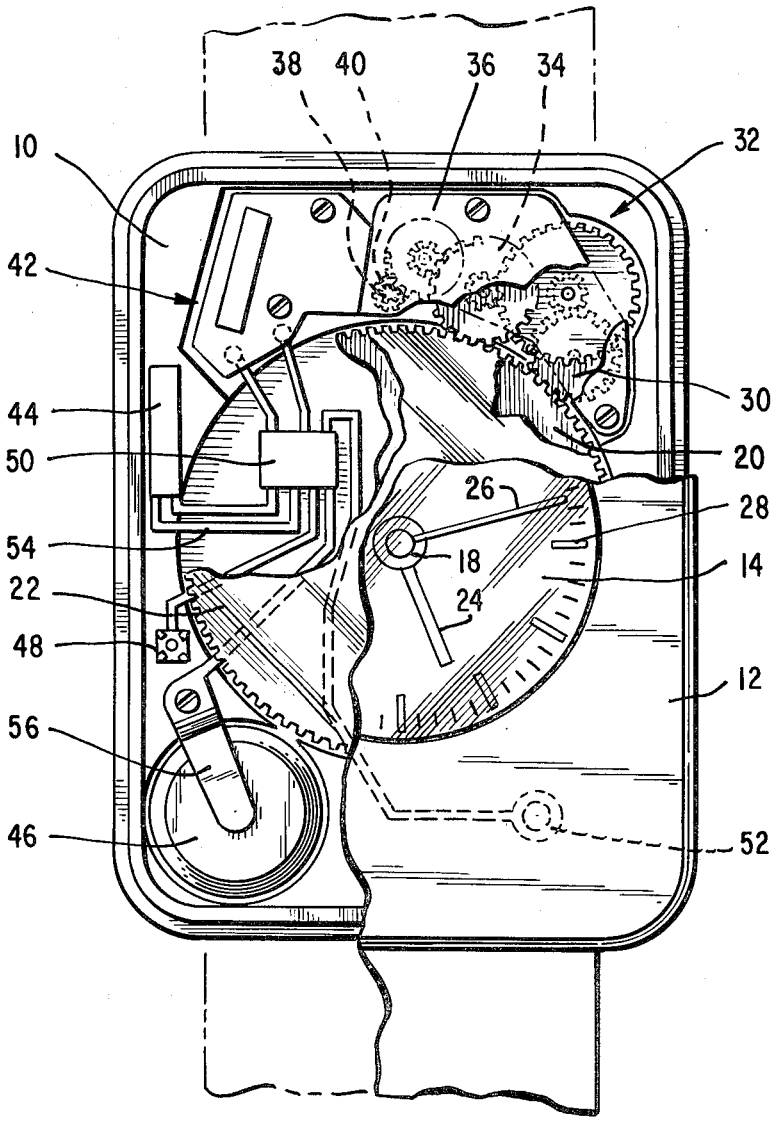
FIG. 1 is a sectional plan view of a first embodiment of a watch according to the invention.
Figure 2A:
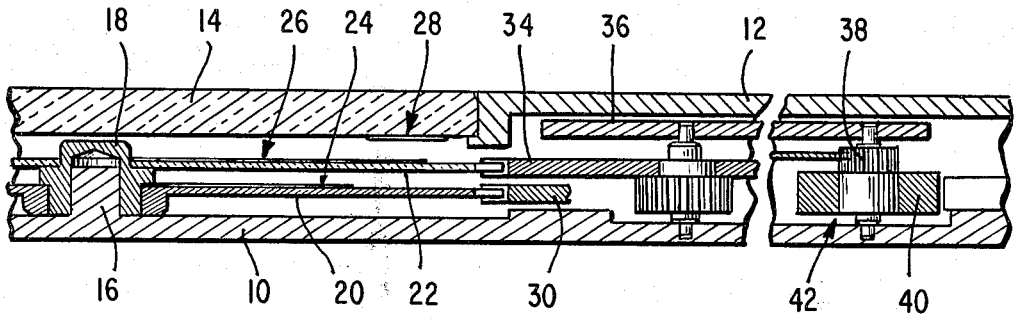
FIGS. 2*a* and 2*b* are partial sectional views of the watch shown in FIG. 1.
Figure 2B:
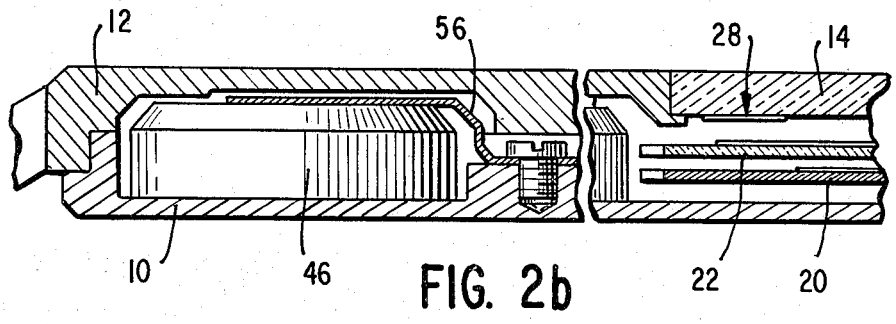

FIGS. 1, 2*a* and 2*b* illustrate a watch formed by a back 10 constituting the plate for the movement and a combined caseband and bezel 12 covering the back 10. A transparent window 14 which is advantageously made of mineral glass is fixed in the bezel 12. The back 10 has a stud 16 in its center, with an arbor 18 fitted on it (FIG. 2*a*). Two discs 20 and 22 which constitute the hour disc and the minute disc respectively and, for this purpose, exhibit radial index marks 24 and 26 acting as hour hand and minute hand respectively, pivot freely about this arbor. These index marks can be either transfer-printed onto the discs or embossed, the latter being preferable as it makes them look more like hands. Some fixed markings 28 are also transfer-printed or metallized on the internal surface of the window 14 to form, for example, a conventional graduation into minutes and hours.

The upper disc 22 (minute disc) is made of transparent material, while the lower disc 20 (hour disc) is metal-coated so that it can appear as a dial.

The hour disc 20 has teeth round its circumference so that it can be driven by the last gear 30 in a gear train 32 at a speed of two revolutions per day. The minute disc 22 also has teeth round its circumference so that it can be driven by an intermediate gear 34 in the gear train 32 at a speed of one revolution per hour. The teeth round the outside of the discs are concealed by the bezel 12; in other words, the window 14 is slightly smaller in diameter than the discs.

As shown clearly in FIG. 1, the gear train 32 is arranged completely outside the periphery of the discs 20 and 22.

The gears of the gear train 32 pivot in bearings which are mounted respectively in the back 10 and in a bridge 36 which is integral with the back 10 and is accommodated in a recess in the caseband-bezel 12. The upper bearings are therefore at a higher level than the internal surface of the window 14.

The first pinion 38 of the gear train is mounted on the rotor spindle 40 of a conventional step-by-step motor 42 which is magnetically screened and is positioned outside the areas of the display discs. The upper and lower bearings of the rotor 40 are mounted in the back 10 and in the bridge 36 respectively. The upper portion of the motor also occupies a recess in the caseband-bezel 12 and is therefore at a higher level than the base of the window 14.

A quartz crystal 44 and a power cell 46, which are other "thick" elements of a watch of this type, are positioned outside the areas of the discs, the motor 42 and the gear train 32 being placed in recesses in the back 10 of the case. The upper portions of these elements also fit in recesses in the caseband-bezel 12 and are thus at a higher level than the inner surface of the window 14.

A frequency trimmer 48 which allows the time-keeping of the watch to be adjusted is also located outside the periphery of the display discs in the vicinity of the power cell 46.

The hour disc 20 conceals an integrated circuit 50 containing, in the conventional manner for this type of watch, a circuit for maintaining the oscillations of the quartz crystal, a frequency divider, a circuit for controlling the motor by means of the output pulses from the divider and a circuit for setting the watch. A pushbutton control means, which is represented schematically at 52 in FIG. 1 and can be reached from the back, is used to set the watch. The integrated circuit 50 is arranged on a printed circuit 54 which is fixed on the back of the casing and provides the necessary connections between the integrated circuit and the step-by-step motor, the quartz crystal, the power cell and the pushbutton. The power cell 46 is connected to the printed circuit 54 by means of a strap 56.

The gear train, the step-by-step motor, the quartz crystal and the power cell thus can protrude to a higher level than the internal surface of the window 14. The thick elements of the watch are arranged in this particular way and are positioned so that they do not overlap when viewed in a direction perpendicular to the front plate of the watch and are outside the periphery of the display discs, with the back 10 of the casing being used as the bottom plate for the movement. This unique combination of features makes it possible to produce extremely flat watches while using components which have normal dimensions and correspondingly excellent reliability.

Figure 3:
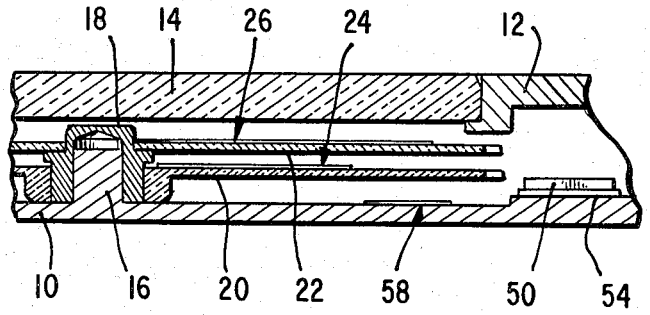
FIG. 3 is a partial sectional view of a second embodiment of a watch according to the invention.

A variation of the illustrative watch embodiment described above is shown partly in section in FIG. 3, the elements which are common to the two embodiments being designated by the same reference numerals. In the watch modification of FIG. 3, the integrated circuit 50 and the printed circuit 54 are also arranged outside the periphery of the display discs 20 and 22. The hour disc 20 can thus be made transparent, like the minute disc 22, and the back 10 of the casing forms the dial. Some fixed markings 58 forming a time graduation are shown as disposed on the back 10. With this arrangement, it is possible to provide a watch which can be even flatter than the one shown in FIGS. 1 and 2 since it utilizes only the hour and minute display discs in its center portion.

Figure 4:
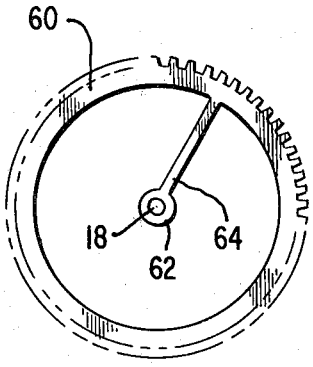
FIG. 4 shows a simplified display disc diagrammatically.

In this embodiment, the two display discs can be simplified considerably and, as shown diagrammatically in FIG. 4, each need only comprise a rim 60 with external teeth, a central hub 62 for fixing it to the spindle 18, and a spoke 64 connecting the central hub to the rim. This spoke constitutes and/or carries the hour or minute hand. It is obvious that a similar construction can be adopted for the minute disc of the watch shown in FIGS. 1 and 2, in which case, however, the hour disc has to be completely opaque so as to conceal the integrated circuit and the printed circuit. These simplified discs can be produced by stamping or electro-forming methods.

Many modifications are possible to the specific illustrative embodiments described, within the scope of the invention as claimed. For example, the upper surface of the rim can be used to complement the dial and, for this purpose, can exhibit decorative markings to enhance the appearance of the watch. Therefore, while the invention has been illustrated and described as comprising one or more preferred embodiments, it is not intended that this disclosure be limited to the details shown, and various changes may be made by those skilled in the art without departing from the spirit of the invention as disclosed and claimed herein.

What is claimed is:

1. An electronic watch comprising:

a casing having a planar front plate including a transparent window in one portion thereof, said window being provided with a lower face directed towards the interior of the casing, a back plate substantially parallel to said front plate; and having within said casing;

time display means visible beneath said transparent window and comprising two pivotally mounted coaxial discs having external teeth arranged around the periphery of said discs and provided with index marks acting as an hour hand and a minute hand respectively;

a driving unit including a motor and a gear train driven by said motor and comprising a plurality of gears meshing with said external teeth of said discs, a quartz crystal resonator and an integrated circuit for controlling said motor; and a power cell for feeding said motor, said quartz crystal resonator and said integrated circuit;

said power cell, said resonator and said driving unit being mounted on said back plate at least partially at the same level as said display means without substantially overlapping one another and said discs when viewed in a direction perpendicular to said front plate of the watch, and the upper portion of at least one of said motor, gear, quartz crystal resonator or power cell being at least at the same level as the lower face of said window.

2. An electronic watch according to claim 1 wherein the disc mounted closest to the window is transparent and to the other disc serves as a dial.

3. An electronic watch according to claim 1 wherein the two discs are transparent and the back plate of the casing serves as a dial.

4. An electronic watch according to claim 1 wherein the disc mounted closest to the window comprises a rim having said external teeth, a central hub and a spoke connecting the rim to the central hub, and wherein the other disc serves as a dial.

5. An electronic watch according to claim 1 wherein each of the two coaxial discs comprises a rim having said external teeth, a central hub and a spoke connecting the rim to the hub, and wherein the back plate of the casing acts as a dial.

6. An electronic watch according to claim 1 wherein the gear train pivots in the back of the casing and in a bridge arranged in a recess in the casing, the upper level of which recess is above the lower portion of the transparent window.

7. An electronic watch according to any one of claims 1 to 5, wherein the two coaxial discs pivot about a spindle which is an integral part of the back plate of the casing.

8. An electronic watch according to any one of claims 1 to 5 wherein the casing comprises a combined caseband and bezel which supports the transparent window and is fixed to the back plate.

9. An electronic watch according to any one of claims 1 to 5 wherein said integrated circuit is also located outside the periphery of the coaxial discs.

10. An electronic watch according to any one of claims 1 to 5 wherein at least one of said power cell, motor, gear train and quartz crystal resonator has its upper portion located above the lower portion of the transparent window.

* * * * *